US005537920A

United States Patent [19]

Hasegawa et al.

[11] Patent Number: 5,537,920

[45] Date of Patent: Jul. 23, 1996

[54] ROTARY STENCIL PRINTING DRUM EQUIPPED WITH A WIRELESS DATA COMMUNICATION DEVICE

[75] Inventors: Takanori Hasegawa; Junji Takahashi; Ryuji Higa, all of Tokyo-to, Japan

[73] Assignee: Riso Kagaku Corporation, Kyoto, Japan

[21] Appl. No.: 522,080

[22] Filed: Aug. 31, 1995

Related U.S. Application Data

[63] Continuation of Ser. No. 202,487, Feb. 28, 1994, abandoned.

[30] Foreign Application Priority Data

Mar. 1, 1993 [JP] Japan ..... 5-039160

[51] Int. Cl.[6] ..... B41L 13/04; B41F 15/40

[52] U.S. Cl. ..... 101/116; 101/119

[58] Field of Search ..... 101/114–129

[56] References Cited

U.S. PATENT DOCUMENTS

| | | | |
|---|---|---|---|
| 3,779,161 | 12/1973 | Tatebe | 101/123 |
| 4,366,542 | 12/1982 | Anselrode | 101/116 |
| 4,563,947 | 1/1986 | Matsushita et al. | 101/122 |
| 4,817,524 | 4/1989 | Riemer | 101/123 |
| 4,871,269 | 10/1989 | Murata | 400/88 |
| 5,233,918 | 8/1993 | Hale | 101/122 |
| 5,245,922 | 9/1993 | Klemm | 101/115 |
| 5,252,838 | 10/1993 | Timblin | 101/115 |
| 5,335,594 | 8/1994 | Karlyn et al. | 101/35 |

FOREIGN PATENT DOCUMENTS 2056708 5/1971 France .

*Primary Examiner*—Stephen Funk
*Attorney, Agent, or Firm*—Dickstein, Shapiro & Morin

[57] ABSTRACT

To allow data to be exchanged between a printing drum and a stencil printing device main body in a highly adaptable manner with regard to the increase in the kinds of data to be transmitted without requiring any change in mechanical structures, light emitting devices 43, 65 and light receiving devices 45, 63 are arranged in mutually opposing parts of the printing drum 7 and the main body frame 1 to allow optical communication between them. Other modes of wireless communication may be used in place of the optical communication. This invention is particularly useful when the printing drum 7 is detachably mounted on a main body frame 1 of the stencil printing device, and the main control unit is required to adapt itself to different printing drums.

12 Claims, 5 Drawing Sheets

ROTARY STENCIL PRINTING DRUM EQUIPPED WITH A WIRELESS DATA COMMUNICATION DEVICE

This application is a continuation, of application Ser. No. 08/202,487, filed Feb. 28, 1994, now abandoned.

TECHNICAL FIELD

The present invention relates to a rotary stencil printing device, and in particular to a rotary stencil printing device including a printing drum detachably mounted on a stencil printing device main body, and a printing drum adapted to be used in such a stencil printing drum.

BACKGROUND OF THE INVENTION

According to well known stencil printing devices, printing ink is supplied to the interior of a printing drum, and printing paper is pressed, by a press roller, onto a stencil master plate wrapped around the outer circumferential surface of the printing drum to achieve a desired stencil printing. Some of such stencil printing devices are provided with a printing drum which is detachable from the stencil printing device main body so that stencil printing of different colors can be achieved by changing the printing drum as required. Such a stencil printing device is disclosed in Japanese patent publication (kokoku) No. 62-28758.

According to such a stencil printing device, because an ink supply system, including an ink supply pump, an ink level sensor and so on, is provided inside the printing drum, and is controlled by a control unit consisting of a microcomputer or the like provided in the stencil printing device main body, it is necessary to exchange data between the printing drum and the stencil printing device main body.

Conventionally, two halves of a multi-pin connector were provided in the printing drum and the stencil printing device main body, respectively, so that the two halves may be connected to each other by the mounting of the printing drum onto the stencil printing device main body, and the data transmission between the printing drum and the stencil printing device main body may be achieved electrically via the connector and the wiring associated with the connector.

However, according to such a conventional mode of data transmission, as the kinds of data to be transmitted between the printing drum and the stencil printing device main body increases primarily due to the diversification of the kinds of the printing drums, the numbers of pins and wires associated with the connector have to be increased accordingly, and this limits the adaptability of the stencil printing device to the increase in the kinds of data to be transmitted.

BRIEF SUMMARY OF THE INVENTION

In view of such problems of the prior art, a primary object of the present invention is to provide an improved rotary stencil printing device equipped with a printing drum detachably mounted on a stencil printing device main body which allows exchange of data between the printing drum and the stencil printing device main body so that an ink supply system inside the printer drum can be controlled by a control unit provided in the printing device main body without requiring any contact between them.

A second object of the present invention is to provide an improved rotary stencil printing device equipped with a printing drum detachably mounted on a stencil printing device main body which allows information on the type of the printing drum to be communicated to a control unit provided in the stencil printing device main body without requiring any contact between the printing drum and the stencil printing device main body.

A third object of the present invention is to provide a stencil printing device which can adapt itself to different kinds of printing drums without changing its mechanical structure.

A fourth object of the present invention it to provide a stencil printing device which is simplified in structure through elimination of electric contacts between the printing drum and the stencil printing device main body.

A fifth object of the present invention is to provide a stencil printing device which is reliable in operation through elimination of failures which might arise from poor contact in the electric connection between the printing drum and the stencil printing device main body when an electric connector is used between them.

A sixth object of the present invention is to provide a printing drum which is suitable for use in such a stencil printing device.

These and other objects of the present invention can be accomplished by providing a rotary stencil printing device, comprising: a stencil printing device main body; a printing drum incorporating a sensor and mounted on the stencil printing device main body; and wireless data communication means consisting of a first part carried by the printing drum and a second part carried by the stencil printing device main body; and main control means mounted on the stencil printing device main body for controlling the stencil printing device according to an output from the sensor transmitted thereto via the wireless data communication means.

Thus, the stencil printing device can be controlled by the main control means according to data transmitted from the printing drum with a simple structure without requiring a connector or numerous connector wires in a highly reliable fashion free from the possibility of any poor contact. Preferably, the wireless data communication is carried out in a bidirectional fashion, and may use a modulated serial data signal which can be demodulated into a plurality of individual signals. For instance, the signals may include a control signal supplied from a sensor incorporated in the printing drum and transmitted to the main control means via the wireless data communication means so that the main control means may control the stencil printing device in an appropriate manner. It is also possible for the main control means to control the ink supply control means by feedback control.

Furthermore, if the printing drum is a replaceable one for the purpose of color printing or adapting the printer for different specifications, the main control means can readily adapt itself to different printing drums without changing its mechanical structure. Typically, such changes can be accommodated by changing the software for the data communication.

According to a preferred embodiment of the present invention, the wireless data communication means consists of an optical data communication system. Typically, the optical data communication means comprises a first light emitting device and a first light receiving device carried by the printing drum, and a second light emitting device and a second light receiving device carried by the stencil printing device main body, the first and second light emitting devices being so positioned that they oppose the first and second light receiving devices at least during a part of a period of operation of the stencil printing device.

The data communication may take place only during a part of the period of stencil printing operation, but it is more preferable to keep the communication always established during the period of stencil printing operation. In such a situation, it is highly advantageous if the light emitting and receiving devices are arranged in an area adjacent to a rotational center of the printing drum.

For instance, the stencil printing device main body may be provided with a hollow drive shaft for rotatably carrying the printing drum while the printing drum is provided with a hollow connecting shaft adapted to be fitted onto or into the drive shaft in a power transmitting relationship so that transmission of light between the light emitting devices and the light receiving devices may be carried out through a cavity defined inside the drive shaft and the connecting shaft.

If there is any restriction in the placement of any one of the light emitting and receiving devices, it is possible to place it away from the rotational center of the printing drum, and use an optical fiber to lead light from this device to the center of rotation.

The sensors which may be carried by the printing drum include a printing ink bottle detecting sensor, a printing ink level sensor, and a printing ink viscosity sensor.

Alternatively, the wireless data communication means may consist of an ultrasonic data communication system or a data communication system based on electromagnetic induction. As a matter of fact, any wireless or contactless mode of communication is applicable to the present invention.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
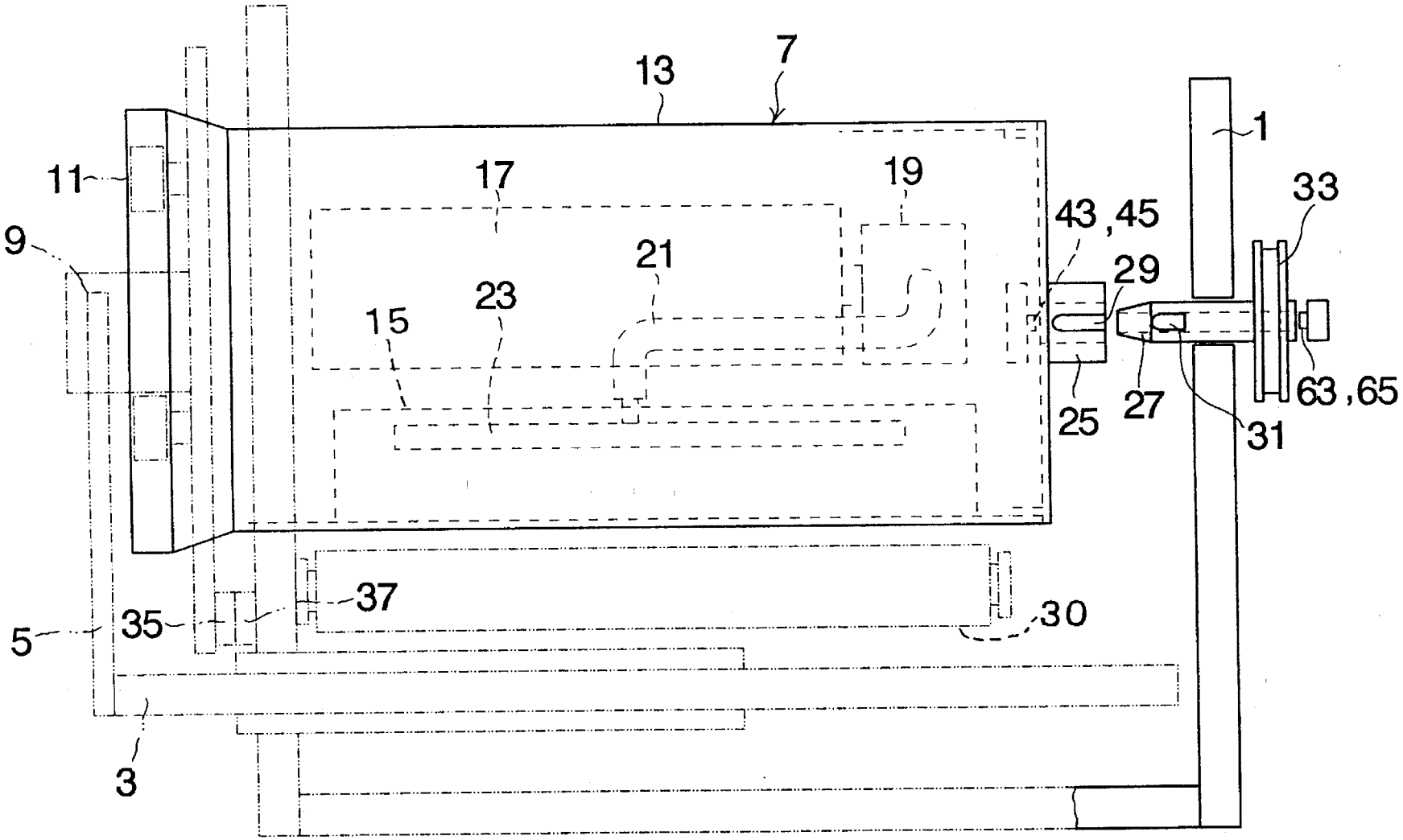
FIG. 1 is a simplified structural view showing an embodiment of the stencil printing device and the printing drum according to the present invention.

FIG. 1 shows an embodiment of each of the stencil printing device and the printing drum according to the present invention. The stencil printing device comprises a main body frame 1 which is provided with a sliding rail 3 in a laterally slidable manner as seen in FIG. 1.

The sliding rail 3 is provided with a drum support bracket 5 standing upright therefrom for detachably engaging a fixed support member 9 of the printing drum 7. Thus, the printing drum 7 can be detachably supported by the sliding rail 3 which is in turn laterally moveable between its leftmost position for replacing the printing drum 7 and the right most position inside the main body frame 1 for printing operation.

The printing drum 7 comprises a cylindrical printing drum main body 13 which is rotatably supported by the fixed support member 9 via rollers 11. The printing drum main body 13 comprises an ink permeable multi-layered structure formed by a porous structure and a screen, and incorporates therein a squeegee roller 15 rotatably supported by a fixed supporting member not shown in the drawing, a detachably mounted ink bottle 17, and a fixedly disposed ink supply pump 19.

The ink supply pump 19 is actuated by a pump drive motor 61 (refer to FIG. 2), and draws printing ink from the ink bottle 17 and delivers the printing ink to an ink delivery pipe 23 of a squeegee roller unit via an ink supply hose 21.

A connecting shaft 25 is fixedly attached to a central part of an end surface of the printing drum main body 13. The connecting shaft 25 consists of a hollow shaft provided with a key slot 29 so that a drive shaft 27 rotatably supported by the main body frame 1 can fit into the connecting shaft 25 in a drivable relationship with a key 31 of the drive shaft 27 fitted into the key slot 29 of the connecting shaft 25 when the printing drum 7 supported by the sliding rail 3 is brought into the position for printing operation.

The drive shaft 27 is provided with a pulley 33 which is rotatively driven by a printing drum drive motor not shown in the drawing so that the printing drum main body 13 is rotatively driven around its axial center line.

A stencil printing is carried out by wrapping a stencil master plate not shown in the drawing around the outer circumferential surface of the printing drum main body 13, and pressing printing paper onto the stencil master plate with a press roller 30 while the printing drum main body 13 is rotating.

The fixed support member 9 and the main body frame 1 are provided with two halves of a power connector 35 and 37 which establish an electric connection between each other when the fixed support member 9 and the main body frame 1 are bought into the position for printing operation with the printing drum 7 carried by the sliding rail 3, and electric power is supplied from the main body frame 1 to a power circuit 39 (refer to FIG. 2) provided inside the printing drum main body 13 via the two halves of the power connector 35 and 37.

Figure 2:
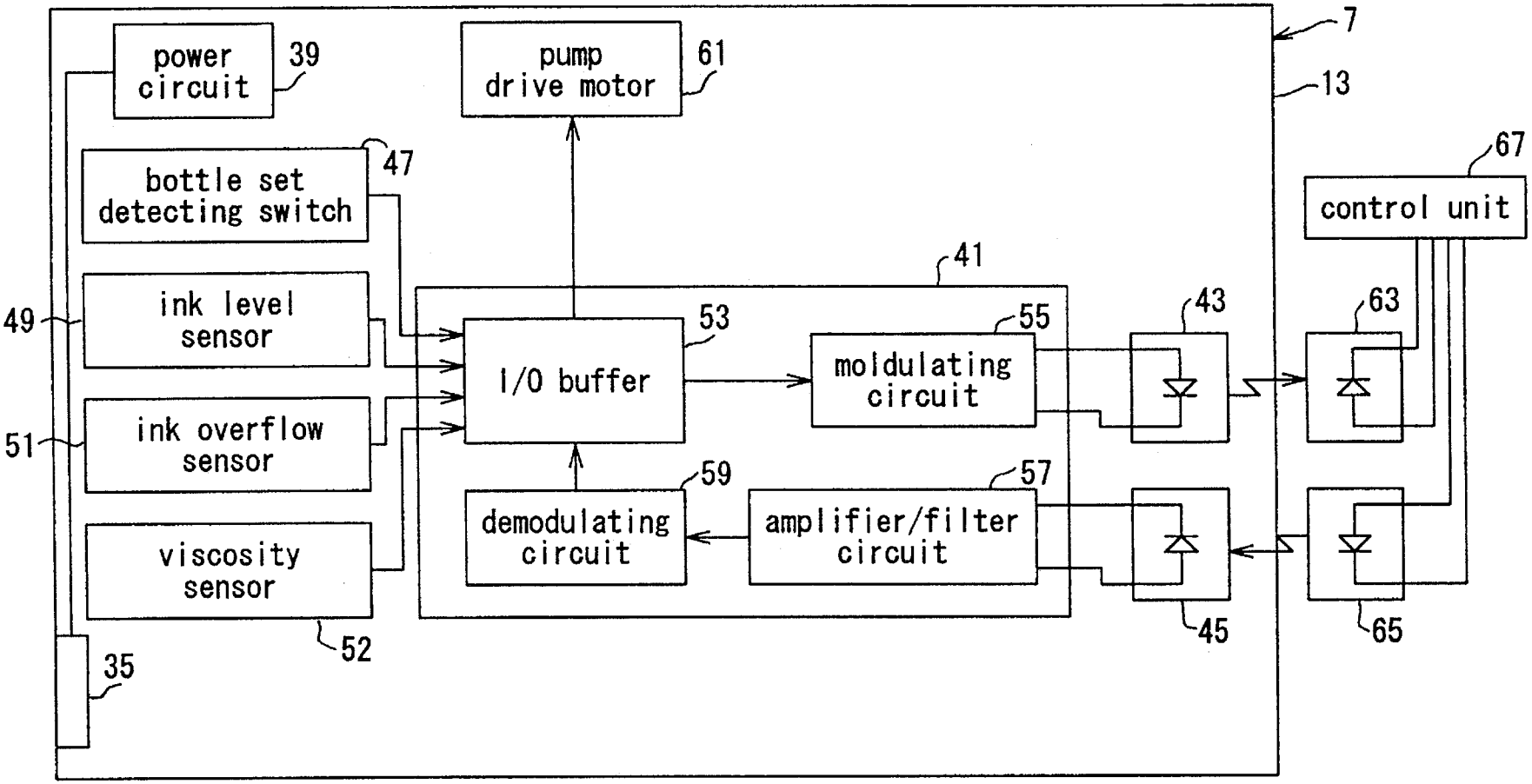
FIG. 2 is a block diagram showing an embodiment of the control system installed inside the printing drum main body in the stencil printing device and the printing drum according to the present invention.

FIG. 2 shows the control system provided inside the printing drum main body 13. This control system comprises a printed circuit board 41 drawing electric power from the power circuit 39, a light emitting device 43 and a light receiving device 45 for optical communication, a bottle set detecting switch 47 for detecting the placement of an ink bottle 17, an ink level sensor 49 for detecting the level of the printing ink in the area of the squeegee roller, an ink overflow sensor 51 for detecting an excessive rise in the ink level in the area of the squeegee roller, and a viscosity sensor 52 for measuring the viscosity of the printing ink. The viscosity sensor 52, for instance, may consist of a current sensor for measuring electric current supplied to the electric motor 61 which, as described earlier, drives the pump 19 for delivering printing ink so that the viscosity may be measured from the magnitude of the load acting upon the pump 19.

The printed circuit board 41 receives signals via its I/O buffer 53 from the bottle set detecting switch 47, the ink level sensor 49, the ink overflow sensor 51, and the viscosity sensor 52, and modulates these signals, with its modulating circuit 55, into a prescribed serial transmission data signal, which can be individually identified for different data signals, to be delivered to the light emitting device 43.

The printed circuit board 41 also receives a light reception signal obtained from the light receiving device 45 into its amplifier and filter circuit 57, and demodulates this signal with its demodulation circuit 59 to be delivered to the pump drive motor 61 via the I/O buffer 53 as a pump motor drive signal.

As illustrated in FIG. 1, the light emitting device 43 and the light receiving device 45 are provided in a recessed portion of the connecting shaft 25 opposing the drive shaft 27.

A light receiving device 63 and a light emitting device 65 are fixedly secured to a portion of the main body frame 1 opposing the light emitting device 43 and the light receiving device 45, respectively. The drive shaft 27 consists of a hollow shaft so that the light emitting device 43 and the light receiving device 45 are allowed to oppose the light receiving device 63 and the light emitting device 65, respectively, through a continuous hollow section inside the connecting shaft 25 and the drive shaft 27, and the light receiving devices 45 and 63 receive light from the associated ones of the light emitting devices 43 and 65.

The light receiving device 63 and the light emitting device 65 are connected to a control unit 67 of the main body frame 1 consisting of a microcomputer or the like, and the control unit 67 supplies a serial transmission data signal for driving the pump motor to the light emitting device 65 according to the light reception signal obtained from the light receiving device 63.

In this case, by virtue of the exchange of light between the light receiving device 45 and the light emitting device 65 and between the light receiving device 63 and the light emitting device 43, a bidirectional data transmission is established between the printed circuit board 41 of the printing drum main body 13 and the control unit 67 of the main body frame 1 in the form of an optical transmission which for instance may consist of a multi-channel optical transmission capable of individually transmitting a plurality of data signals.

The control unit 67 can thus receive data from the bottle set detecting switch 47, the ink level sensor 49, the ink overflow sensor 51, and the viscosity sensor 52, via the wireless data communication means, and can appropriately control the operation of the stencil printing device. For instance, the pressure at which the press roller is pushed onto the printing drum may be appropriately changed according to the viscosity of the printing ink detected by the viscosity sensor 52.

If the stencil printing device is adapted for multi color printing, the printing drum 7 may be additionally provided with sensor means for detecting the color of the printing ink from a mark or a code provided on the bottle of the printing ink.

Figure 3:
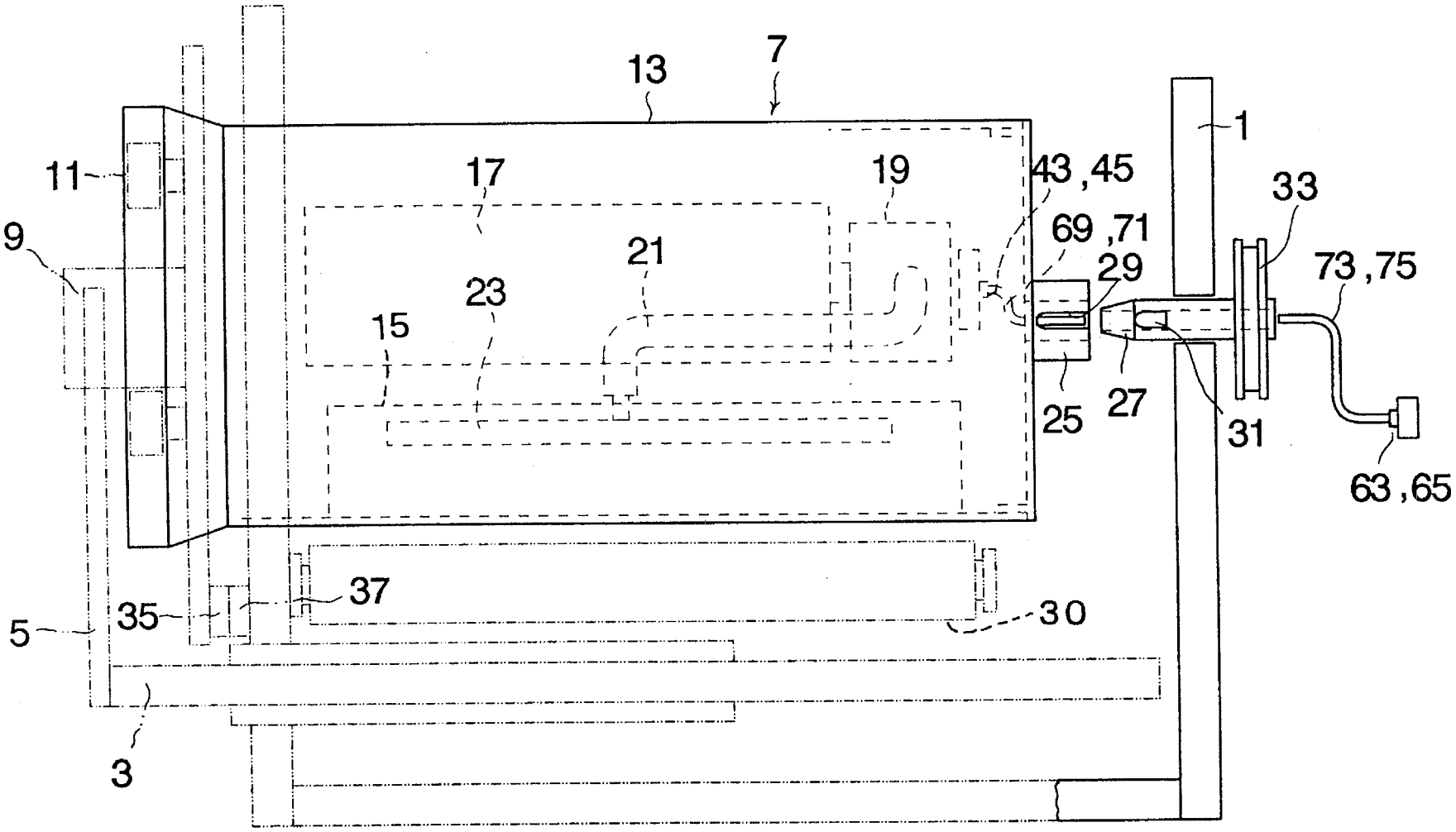
FIG. 3 is a simplified structural view showing another embodiment of the stencil printing device and the printing drum according to the present invention.

FIG. 3 shows another embodiment of the stencil printing device and the printing drum according to the present invention. In FIG. 3, the parts corresponding to those of FIG. 1 are denoted with like numerals. In this embodiment, the pair consisting of the light emitting device 43 and the light receiving device 45, and the pair consisting of the light receiving device 63 and the light emitting device 65 are arranged in mutually displaced positions, and optical fibers 69 and 71, and 73 and 75 are connected to these devices and the end surfaces of these optical fibers are placed opposite to each other as light emitting surfaces and light receiving surfaces as required so that the bidirectional data transmission may be accomplished through these optical fibers.

In this embodiment, the optical fibers connected to the light emitting device 43 and the light receiving device 45 extend into the cavity of the connecting shaft 29 so that the air gaps in the light transmission paths are minimized. If desired, the optical fibers 73 and 75 connected to the light receiving device 63 and the light emitting device 65 may also extend into the cavity of the drive shaft 27.

It is also possible to use reflecting mirrors to transmit the light from the light emitting devices 43 and 65 to the light receiving devices 45 and 63.

Figure 4:
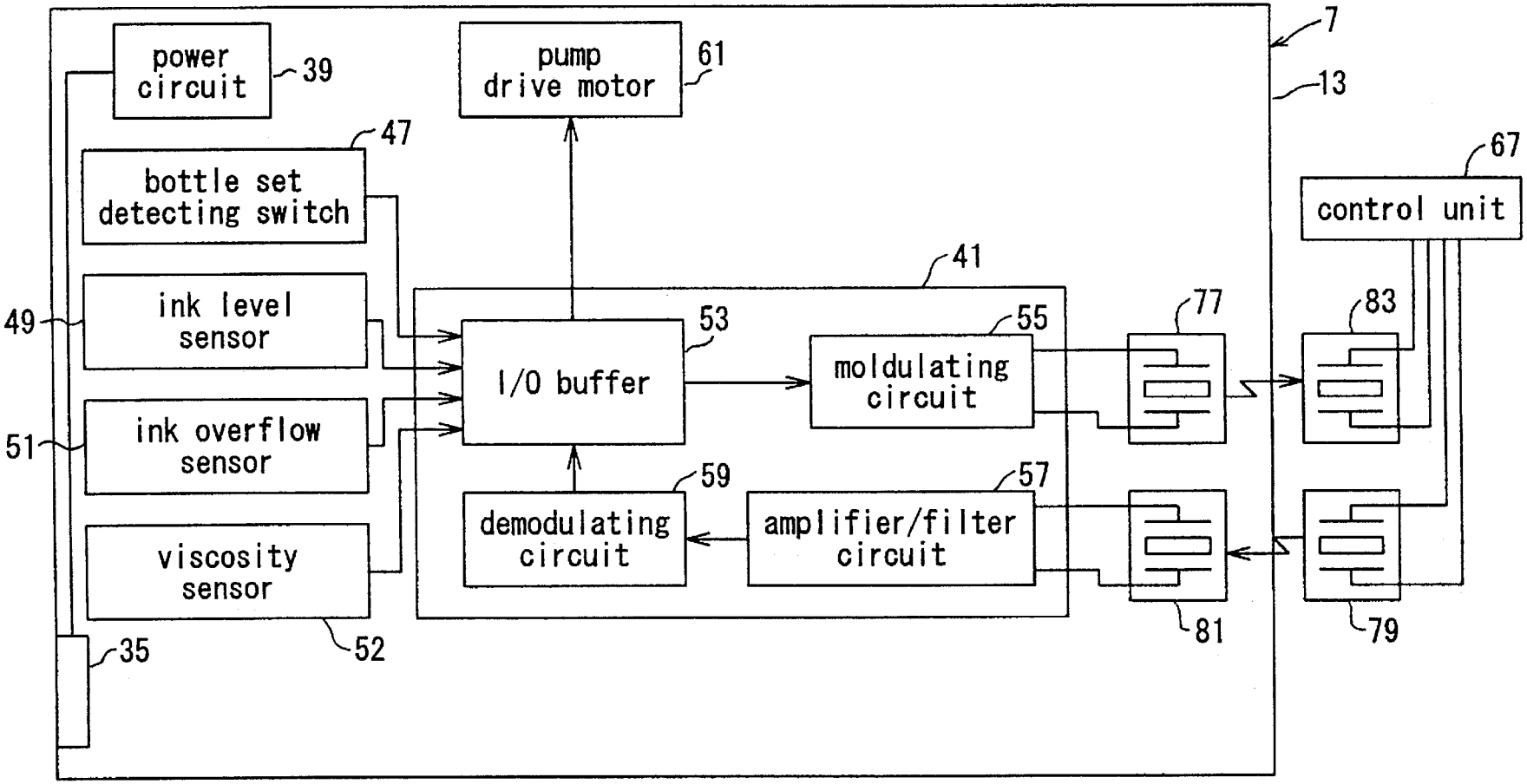
FIG. 4 is a block diagram showing another embodiment of the control system installed inside the printing drum main body in the stencil printing device and the printing drum according to the present invention.
Figure 5:
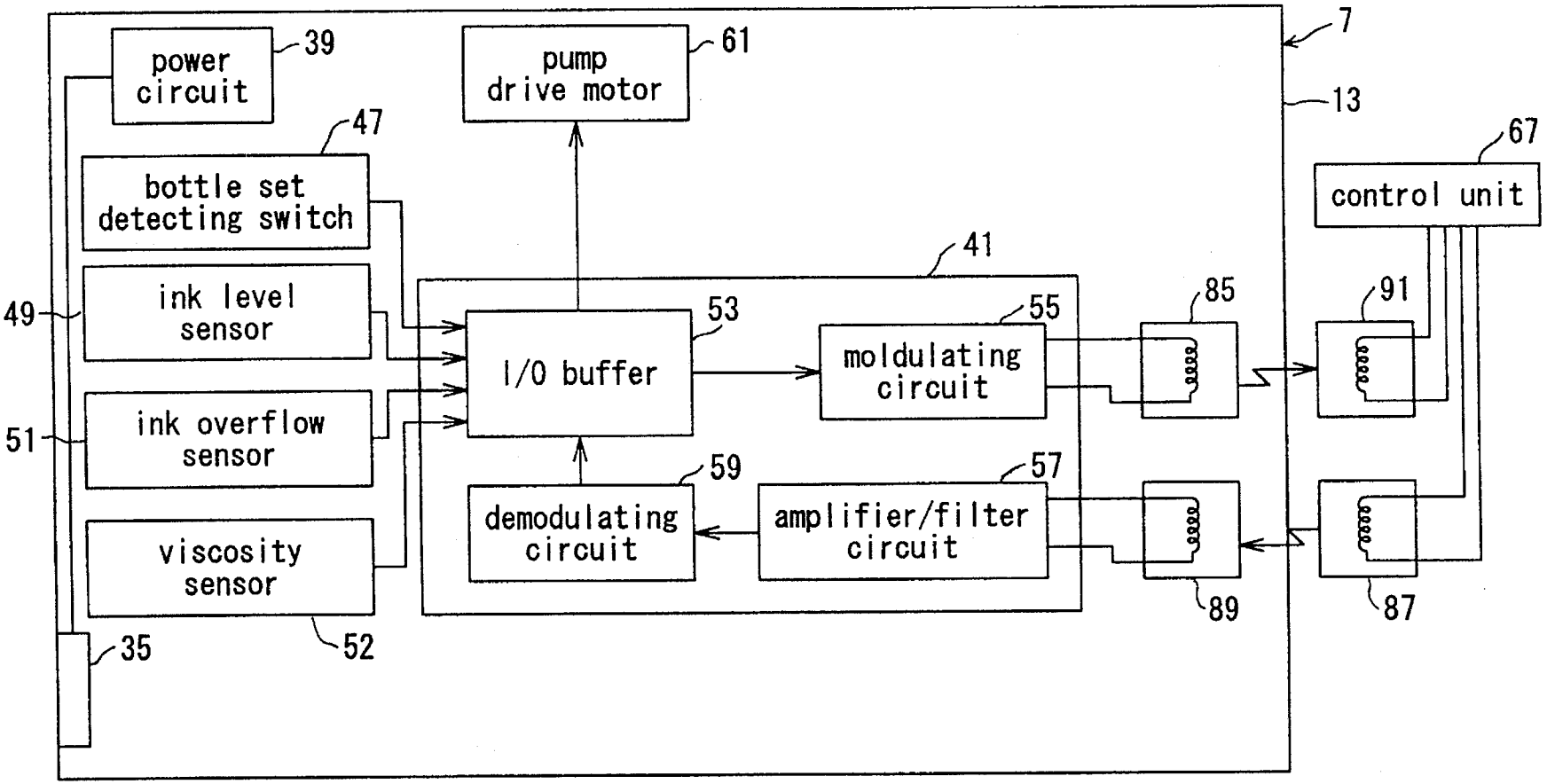
FIG. 5 is a block diagram showing yet another embodiment of the control system installed inside the printing drum main body in the stencil printing device and the printing drum according to the present invention.

FIGS. 4 and 5 show yet other embodiments of the stencil printing device and the printing drum according to the present invention. In FIGS. 4 and 5, the parts corresponding to those shown in FIG. 2 are denoted with like numerals.

In the embodiment illustrated in FIG. 4, ultrasonic transmitters 77 and 79 and ultrasonic receivers 81 and 83 are arranged in the printing drum 7 and the main body frame 1 so that the data transmission between the printing drum 1 and the stencil printing device main body may be carried out by ultrasonic communication without involving any contact. In this case, the modulating circuit 55 consists of an oscillation modulating circuit for ultrasonic transmission.

In the embodiment illustrated in FIG. 5, transmitting coils 85 and 87, and receiving coils 89 and 91 are arranged in the printing drum 7 and the main body frame, instead of the light emitting devices 43 and 65 and the light receiving devices 45 and 63, so that the data transmission between the printing drum 1 and the stencil printing device main body may be carried out by communication based on electromagnetic induction without involving any contact. In this case, the modulating circuit 55 consists of an oscillation modulating circuit for electromagnetic induction transmission.

The supply of electric power to the units provided in the printing drum such as the pump drive motor 61 and the control system may be carried out by an electric generator mounted on the printing drum 7 so as to produce electric power from the rotation of the printing drum 7, or a battery. In this case, the two halves of the power connector 35 and 37 can also be omitted.

The contactless transmission between the printing drum and the stencil printing device main body can be based on other modes of wireless communication other than the optical communication, the ultrasonic communication and the electromagnetic induction communication.

As can be understood from the above description, according to the stencil printing device and the printing drum of the present invention, exchange of data between the printing drum and the stencil printing device main body can be carried out without involving any contact between the first part and the second part of the wireless data communication means which may include signal transmitting means such as a light emitting device, an ultrasonic transmitter, and a transmitting coil for electromagnetic induction communication, and signal receiving means such as a light receiving device, an ultrasonic receiver, and a receiving coil for electromagnetic induction communication. Therefore, an improved adaptability for the increase and change in the kinds of data to be transmitted can be achieved because any increase in the kinds of data to be transmitted can be accommodated simply by modifying the software for communication without changing any mechanical structure such as the number of connector pins. Thus, the need for large connectors and numerous wires leading to the connectors can be eliminated, and the space requirements in and around the printing drum can be improved.

When optical communication is selected, there will be less problems with electric noises which might be created when powering up the system and mounting a printing drum, and the reliability of data transmission between the printing drum and the stencil printing device main body can be increased. In particular, failures of data transmission due to bad connection of connectors can be totally eliminated.

Although the present invention has been described in terms of preferred embodiments thereof, it is obvious to a person skilled in the art that various alterations and modifications are possible without departing from the scope of the present invention which is set forth in the appended claims.

What we claim is:

1. A rotary stencil printing device, comprising:

a stencil printing device main body;

a printing drum incorporating a sensor and mounted on said stencil printing device main body;

wireless data communication means consisting of a first part carried by said printing drum and a second part carried by said stencil printing device main body and in wireless communication with said first part, wherein both said first part and said second part are positioned along a rotational axis of said printing drum; and main control means mounted on said stencil printing device main body for controlling said stencil printing device according to an output from said sensor transmitted thereto via said wireless data communication means.

2. A rotary stencil printing device according to claim 1, wherein said wireless data communication means comprises means for bidirectional communication, said printing drum further incorporating an ink supply control means, and said main control means controls said ink supply control means carried by said printing drum according to said output supplied from said sensor via said wireless data communication means in each direction.

3. A rotary stencil printing device according to claim 1, wherein said wireless data communication means consists of an optical data communication means.

4. A rotary stencil printing device according to claim 3, wherein said optical data communication means comprises a first light emitting device and a first light receiving device carried by said printing drum, and a second light emitting device and a second light receiving device carried by said stencil printing device main body, said first and second light emitting devices are so positioned that they oppose said first and second light receiving devices at least during a part of a period of operation of said stencil printing device.

5. A rotary stencil printing device according to claim 4, wherein said stencil printing device main body is provided with a hollow drive shaft for rotatably carrying said printing drum, and said printing drum is provided with a hollow connecting shaft adapted to be fitted onto or into said drive shaft in a power transmitting relationship, transmission of light between said light emitting devices and said light receiving devices being carried out through a cavity defined inside said drive shaft and said connecting shaft.

6. A rotary stencil printing device according to claim 1, further comprising means for detaching said printing drum from said stencil printing device main body so that said printing drum can be exchanged for another by a user of said stencil printing device.

7. A rotary stencil printing device according to claim 1, wherein said wireless data communication means consists of an ultrasonic data communication means.

8. A rotary stencil printing device according to claim 1, wherein said wireless data communication means consists of a data communication system based on electromagnetic induction.

9. A rotary stencil printing device according to claim 1, wherein said sensor comprises a printing ink bottle detecting sensor.

10. A rotary stencil printing device according to claim 1, wherein said sensor comprises a printing ink level sensor.

11. A rotary stencil printing device according to claim 1, wherein said sensor comprises a printing ink viscosity sensor.

12. A rotary stencil printing device, comprising:

a stencil printing device main body;

a printing drum incorporating ink supply control means and mounted on said stencil printing device main body;

wireless data communication means consisting of a first part carried by said printing drum and a second part carried by said stencil printing device main body and in wireless communication with said first part, wherein both said first part and said second part are positioned along a rotational axis of said printing drum; and main control means mounted on said stencil printing device main body for controlling said ink supply control means via said wireless data communication means.

* * * * *